US009398789B2

(12) United States Patent
Blackford

(10) Patent No.: US 9,398,789 B2
(45) Date of Patent: Jul. 26, 2016

(54) ADHESIVE ZIPPER TAPE

(75) Inventor: Michael E. Blackford, Portland, OR (US)

(73) Assignee: IDEAL Fastener Corporation, Oxford, NC (US)

( * ) Notice: Subject to any disclaimer, the term of this patent is extended or adjusted under 35 U.S.C. 154(b) by 0 days.

(21) Appl. No.: 13/424,241

(22) Filed: Mar. 19, 2012

(65) Prior Publication Data

US 2012/0233739 A1 Sep. 20, 2012

Related U.S. Application Data

(60) Provisional application No. 61/454,439, filed on Mar. 18, 2011.

(51) Int. Cl.

| | |
|---|---|
| ***A41D 1/00*** | (2006.01) |
| ***A44B 19/34*** | (2006.01) |
| ***A41H 37/00*** | (2006.01) |

(52) U.S. Cl.

CPC ..... *A44B 19/34* (2013.01); *A41H 37/003* (2013.01); *Y10T 24/25* (2015.01); *Y10T 24/253* (2015.01); *Y10T 24/2529* (2015.01); *Y10T 24/2539* (2015.01)

(58) Field of Classification Search

USPC ..... 24/304, 381

See application file for complete search history.

(56) References Cited

U.S. PATENT DOCUMENTS

| | | | | | |
|---|---|---|---|---|---|
| 3,291,362 | A | * | 12/1966 | Sproull et al. | 229/4.5 |
| 3,785,014 | A | * | 1/1974 | Canepa | 24/381 |
| 3,866,275 | A | | 2/1975 | Van Amburg | |
| 3,925,858 | A | * | 12/1975 | Thaeler | 24/381 |
| 3,969,564 | A | * | 7/1976 | Carder | 428/212 |
| 4,327,470 | A | * | 5/1982 | Lawrence | 29/408 |
| 5,067,207 | A | | 11/1991 | Semons | |
| 2003/0019085 | A1 | | 1/2003 | Loglisci | |
| 2005/0078890 | A1 | * | 4/2005 | Abe et al. | 383/201 |
| 2006/0293128 | A1 | * | 12/2006 | Frischmon et al. | 473/560 |
| 2007/0028430 | A1 | * | 2/2007 | Ahn | 24/399 |
| 2007/0066470 | A1 | * | 3/2007 | Eads et al. | 493/213 |
| 2007/0169318 | A1 | | 7/2007 | Semons | |
| 2008/0019619 | A9 | * | 1/2008 | Eads et al. | 383/61.2 |
| 2009/0000060 | A1 | | 1/2009 | Edens | |
| 2011/0068025 | A1 | * | 3/2011 | Whittemore | 206/225 |

FOREIGN PATENT DOCUMENTS

| | | | |
|---|---|---|---|
| EP | 0399708 | | 11/1990 |
| JP | S50-058906 | | 5/1975 |
| JP | H02-297301 | | 12/1990 |
| JP | H0744883 | B2 | 12/1990 |
| JP | 2000253910 | | 9/2000 |
| RU | 2117581 | C1 | 8/1998 |
| RU | 51833 | | 3/2006 |
| RU | 2277367 | C2 | 6/2006 |
| RU | 20071112229 | A | 10/2008 |

* cited by examiner

*Primary Examiner* — Robert J Sandy
*Assistant Examiner* — Michael Lee
(74) *Attorney, Agent, or Firm* — Schwabe, Williamson & Wyatt, P.C.

(57) ABSTRACT

Embodiments herein provide adhesive zipper tape. A zipper may be coupled to adhesive zipper tape to form a zipper assembly. In various embodiments, the adhesive zipper tape may be coupled to a piece of fabric, such as in a garment, around an opening. The zipper may then be used to open and close the opening. In various embodiments, the adhesive zipper tape may manifest an adhesive quality when activated by an activation stimulus, such as heat or air.

14 Claims, 5 Drawing Sheets

ADHESIVE ZIPPER TAPE

RELATED PATENT APPLICATIONS

The present application claims priority to U.S. Provisional Patent Application Ser. No. 61/454,439, filed Mar. 18, 2011 entitled "Adhesive Zipper Tape," the disclosure of which is hereby incorporated by reference in its entirety.

TECHNICAL FIELD

Embodiments herein relate to the field of zippers, and, more specifically, to adhesive zipper tape.

BACKGROUND

Zippers are widely used to open and close an opening in a piece of fabric and/or to removably/reversably couple two pieces of fabric together. Zippers are used in a wide variety of applications, such as in apparel to open and close an opening on a garment. A typical zipper includes a zipper slider disposed between opposing sets of zipper teeth. As the zipper slider moves along the zipper, the zipper teeth are joined or separated depending on the direction of movement. Each set of zipper teeth is coupled to a strip of sturdy base material. The base material is attached to the garment around the opening to be joined by the zipper.

Typically, the zipper base material is attached to the garment by either stitching the base material to the garment or applying an adhesive to the base material and then attaching the base material to the garment. Both methods add complexity to the manufacturing process. Additionally, both methods add bulk to the base material, causing the base material to be relatively inflexible compared with the surrounding fabric that makes up the garment. Furthermore, the adhesives currently used, typically an air-cured liquid glue or adhesive film, can be difficult to work with. Liquid glue can be messy and must be precisely applied. If too little glue is applied, there may be loose flaps of the base material. However, if too much glue is applied, it may extend beyond the base material, creating a messy appearance and/or interfering with the functionality of the zipper. Similarly, if an adhesive film is used, it must be precisely cut to size to match the base material and avoid excess around the edges. This adds time and expense to the manufacturing process, especially considering that various garments use zippers of different sizes.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1A:
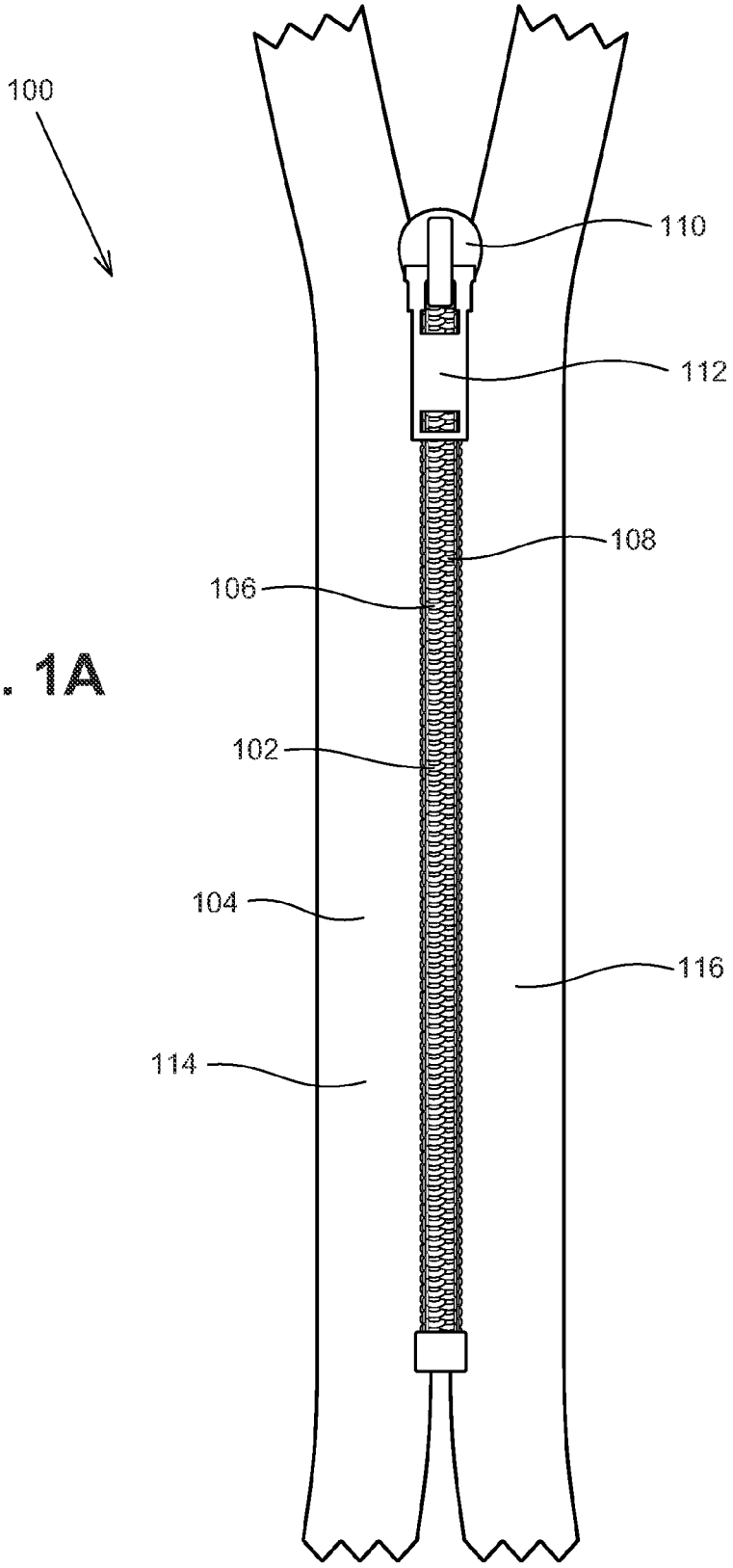
FIG. 1A illustrates a zipper assembly showing a zipper coupled to adhesive zipper tape in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a zipper assembly having a zipper coupled to adhesive zipper tape. The zipper may include a first set of zipper teeth and a second set of zipper teeth. The first set of zipper teeth and the second set of zipper teeth may be coupled to first and second portions, respectively, of the adhesive zipper tape. In various embodiments, the adhesive zipper tape may be coupled to a piece of fabric, such as in a garment, around an opening. The zipper may then be used to open and close the opening. In various embodiments, the adhesive zipper tape may manifest an adhesive quality when activated by an activation stimulus, such as, but not limited to, heat, air, and/or high-frequency energy (e.g., ultrasonic, infrared, and/or radio frequency) activation. The adhesive zipper tape may be a single layer of material.

Embodiments herein contrast with a standard zipper tape in which adhesive is applied to a strip or strips of otherwise non-adhesive material for coupling to a garment. The adhesive is typically brushed, sprayed, or rolled onto the strip(s). As such, the adhesive application process is labor intensive and can be messy. Embodiments herein provide a zipper tape material that itself has an adhesive quality only when activated, thus the adhesive zipper tape can be prepared, cut, manipulated prior to activation without interference with the active adhesive. No additional adhesive application step is needed. When ready, the adhesive zipper tape can be activated and secured to a garment. This arrangement and process reduce manufacturing time and reduce the mess associated with the adhesive application.

In some embodiments, the adhesive zipper tape may include an adhesive that manifests an adhesive quality in response to the activation stimulus, and a stabilizing material that does not become adhesive in response to the activation stimulus. The adhesive and the stabilizing material may be separate layers or may be integrated into a single layer.

The zipper may further include a zipper slider configured to couple the sets of zipper teeth with each other. The zipper slider may be movable along a zipper axis (the longitudinal direction of the zipper defining the opening). As the zipper slider moves in a first direction along the zipper axis, the zipper teeth may interlock with each other (i.e., the zipper closes), and as the zipper mechanism moves in a second direction along the zipper axis, opposite the first direction, the zipper teeth may separate from each other (i.e., the zipper opens). In some embodiments, the zipper may include a plurality of zipper sliders, such as two or more zipper sliders.

In some embodiments, the adhesive zipper tape may be in a deactivated state (e.g., may not have an active adhesive quality) at room temperature (e.g., at a temperature of about 20 degrees Celsius). For example, the adhesive zipper tape may be activated by heat and/or high frequency energy, as described above. In some embodiments, the adhesive zipper tape may be in an activated state when heated to a temperature at or above an activation temperature. The activation temperature is dependent on the particular selected adhesive; however, in embodiments a suitable activation temperature may be in the range of 80 C to 200 C.

When in the activated state, the adhesive zipper tape may be adhesive, such that the adhesive zipper tape will stick to a fabric when it is applied. As the adhesive zipper tape cools below the activation temperature, such as below a deactivation temperature (which may or may not be the same as the activation temperature), the adhesive cures, and the adhesive zipper tape may be permanently or semi-permanently coupled to the fabric.

As used herein, "semi-permanently" coupled refers to an adhesive zipper tape that may not be uncoupled from the fabric when subjected to reasonable force at typical environmental temperatures, but may be uncoupled from the fabric if the adhesive zipper tape is returned to the activation temperature. In various embodiments, a "reasonable force" is at least about 25 lbs, such as 25-30 lbs, if the force is lateral/horizontal and at least about 10 lbs, such as 10-15 lbs, when referring to a vertical lift force. In contrast, "permanently coupled" refers to an adhesive zipper tape that may not be uncoupled from the fabric when subjected to reasonable force even if the adhesive zipper tape is returned to the activation temperature (e.g., one-time, irreversible activation). Suitable heat-activated adhesives for use in the adhesive zipper tape may include polyurethane, polyamide, polyester, polyolefin, and polyethylene.

In various embodiments, the adhesive zipper tape may be composed of a single component or a plurality of components. In embodiments, at least one component of the adhesive zipper tape is an adhesive. In an embodiment, adhesive zipper tape may be constructed from a material that has adhesive qualities only when activated, or at least the adhesive qualities are generally insufficient to provide proper coupling with a target (i.e., fabric) prior to activation. In some embodiments, the adhesive zipper tape may be a single component adhesive film. In other embodiments, in addition to the adhesive, the adhesive zipper tape may include a stabilizing material that may not be activated by the activation stimulus.

For example, in embodiments including a heat activated adhesive, the stabilizing material may be a temperature resistant material, such as a high temperature resistant film, a woven material, and/or a non-woven material. Suitable stabilizing materials may include polyurethane, nylon, polyester, polyethylene, acrylic, and/or another suitable polymer. In embodiments, adhesive may be woven, impregnated, and/or otherwise incorporated into the stabilizing material so that the adhesive and stabilizing material are integrated in a single layer.

As used herein, a "single layer of material" refers to the components of the layer being integrated (combined, mixed, dispersed, etc.), regardless of whether the "single layer" is formed in one or more applications (one or more dips, sprays, depositions, etc.). In contrast a multi-layer application refers to various components being independent layers, such as having being applied sequentially, for example a stabilizing layer applied first followed by a separate adhesive layer applied thereto.

In an embodiment in which the adhesive is integrated with a temperature resistant stabilizing material, the adhesive may be activated by heat to cause the adhesive to melt/soften at the activation temperature, and the stabilizing material may generally maintain its structure at the activation temperature. Accordingly, the stabilizing material may help stabilize the adhesive zipper tape while it is being coupled to the fabric.

In some embodiments, the adhesive zipper tape may include a support layer coupled to the adhesive. In an embodiment, the support layer may be removable. The support layer may stabilize the adhesive while the adhesive is activated and applied to the fabric. The adhesive may not adhere to the support layer when the adhesive is activated, or at least may not adhere significantly when the adhesive is activated. In an embodiment, once the adhesive zipper tape is activated, the support layer may be removed and the adhesive zipper tape may be coupled to the fabric, leaving the adhesive coupled with the first and second sets of zipper teeth. Suitable support layers may include polyethylene film, carrier paper, carrier fabric, etc.

In various embodiments, the adhesive zipper tape may reduce the bulk of the zipper assembly compared with zipper assemblies having multiple layers of material coupled with the zipper in addition to separately applied adhesive. In embodiments, the thickness of the zipper tape may be reduced by approximately 50-95%, such as an approximately 50%, 75%, or 95% reduction in thickness and the weight may be reduced by approximately 50-90%, such as an approximately 50%, 70%, or 90% reduction in weight by comparison to a conventional zipper tape. The single layer of adhesive zipper tape also provides increased pliability and flexibility in the area of the garment surrounding the zipper. Additionally, the adhesive zipper tape may reduce and/or prevent adhesive material from spilling on the garment outside the boundaries of the adhesive zipper tape. Furthermore, the adhesive zipper tape may facilitate a substantially even adhesion over the area of the zipper tape.

In various embodiments, the sets of zipper teeth may be of any suitable type, such as coil/spiral zipper, a nylon zipper, a molded plastic zipper, a molded teeth zipper, a vision zipper, a metal zipper, a plastic zipper, and/or other suitable zipper type. The teeth of each set of zipper teeth may be continuous or semi-continuous elements (e.g., spiral coils, ladder coils) or individual elements (e.g., pegs/teeth). In some embodiments, such as embodiments with a vision zipper, the adhesive zipper tape may include a securing element, such as a ridge and/or a raised edge, to which the sets of zipper teeth may be coupled. The securing element may be formed by extrusion, molding, and/or another suitable method.

In embodiments, zipper teeth may be coupled to the front facing portion of the zipper tape or the teeth may be coupled to the inward facing portion of the zipper tape. In certain embodiments, only one surface of the zipper tape has adhesive qualities. This may be accomplished by selective configuration of an integrated zipper tape layer to orient the adhesive toward the desired surface, or may be accomplished by using multiple layers with adhesive directed toward the desired surface. In an embodiment when zipper tape is configured with one adhesive surface, zipper teeth may be coupled to the adhesive surface or may be coupled to the opposing surface from the adhesive surface.

FIG. 1A illustrates an embodiment of a zipper assembly 100 including a zipper 102 coupled to an adhesive zipper tape 104. The zipper 102 includes a first set of zipper teeth 106 and a second set of zipper teeth 108. First set of zipper teeth 106 and second set of zipper teeth 108 are coupled with a zipper slider 110 having a zipper pull 112. The zipper assembly 100 may be opened and closed by moving zipper slider 110 along the sets of zipper teeth (e.g., along a zipper axis).

Zipper tape 102 includes first strip 114 and second strip 116. The first set of zipper teeth 106 is coupled to the first strip 114 of adhesive zipper tape 104, and the second set of zipper teeth 108 is coupled to the second strip 116 of adhesive zipper tape 104. In various embodiments, the adhesive zipper tape strips 114 and 116 may be used to secure the first set of zipper teeth 102 and the second set of zipper teeth 104 to a garment as described herein.

Adhesive zipper tape 104 may include a heat-activated adhesive. In an embodiment, a heat-activated adhesive may make the zipper tape 104 less messy to apply and may therefore provide a cleaner look and/or a more evenly distributed adhesion than an air-cured adhesive. The adhesive qualities of the heat-activated adhesive may be activated by heating the adhesive zipper tape strips 114 and 116 to or above an activation temperature. The zipper assembly 100 may be applied to the desired location of the garment before, during, or after heating. The heat may be applied by any suitable heating element, such as a heat press, an oven, and/or by application of high-frequency energy. As the zipper tape 104 and the associated adhesive cool, the adhesive cures and the zipper tape 104 may be permanently or semi-permanently coupled to the garment.

Figure 1B:
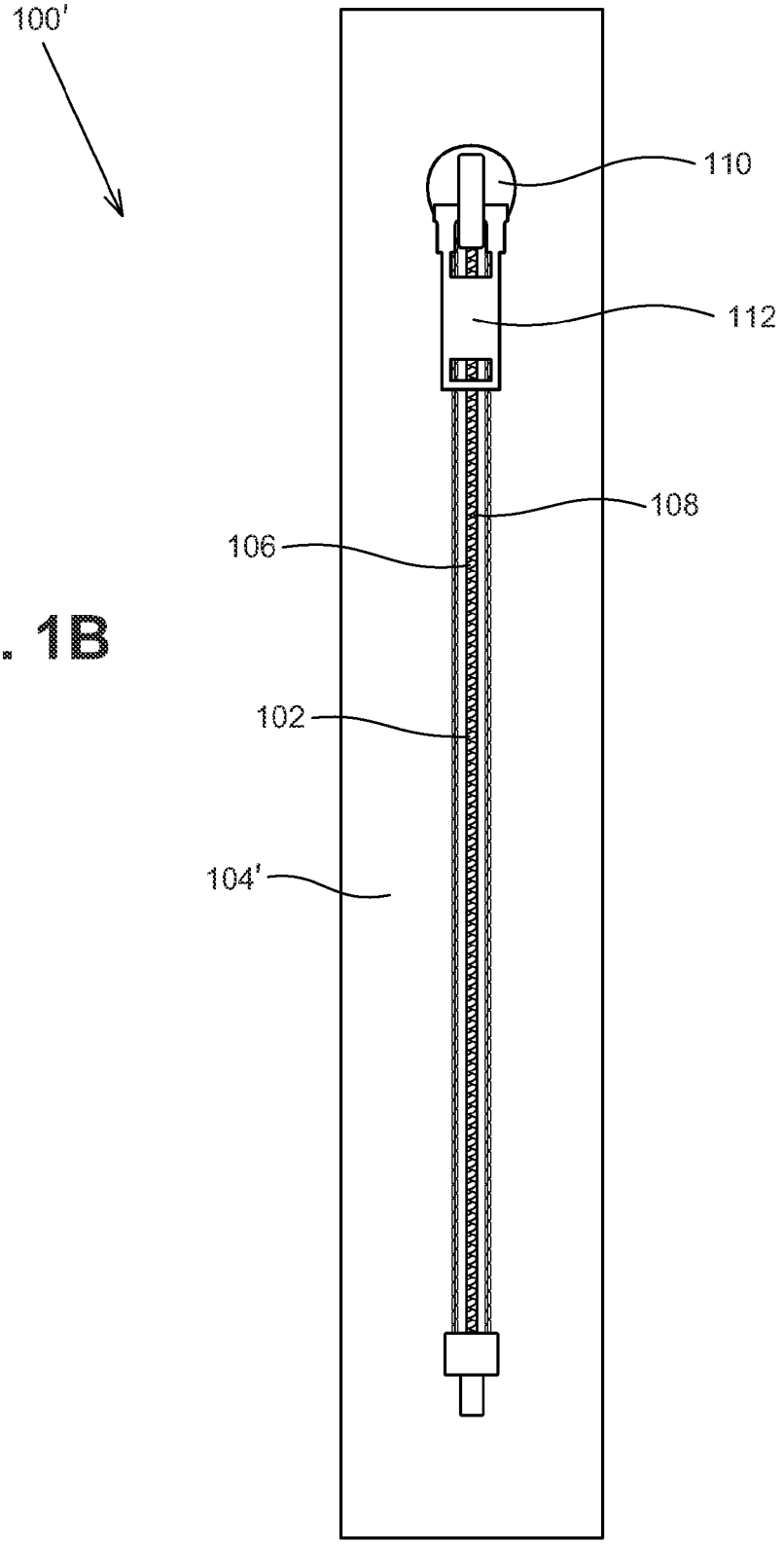
FIG. 1B illustrates an alternative zipper assembly showing a zipper coupled to adhesive zipper tape in accordance with various embodiments.

FIG. 1B illustrates an alternative zipper assembly 100' in which zipper tape 104' is constructed of one piece of material, as opposed to two strips as in FIG. 1A. In such an embodiment, an opening can be formed in a piece of material by cutting, laser etching, etc. and the zipper teeth may be applied to the corresponding edges of the zipper tape 104'. In addition, zipper teeth 106, 108 are coupled to the inward facing surface of the zipper tape 104'. In such a configuration, the outer layer of the associated garment may be configured to cover the outward facing surface of zipper tape 104' providing a clean look and essentially hiding the zipper teeth.

Figure 2:
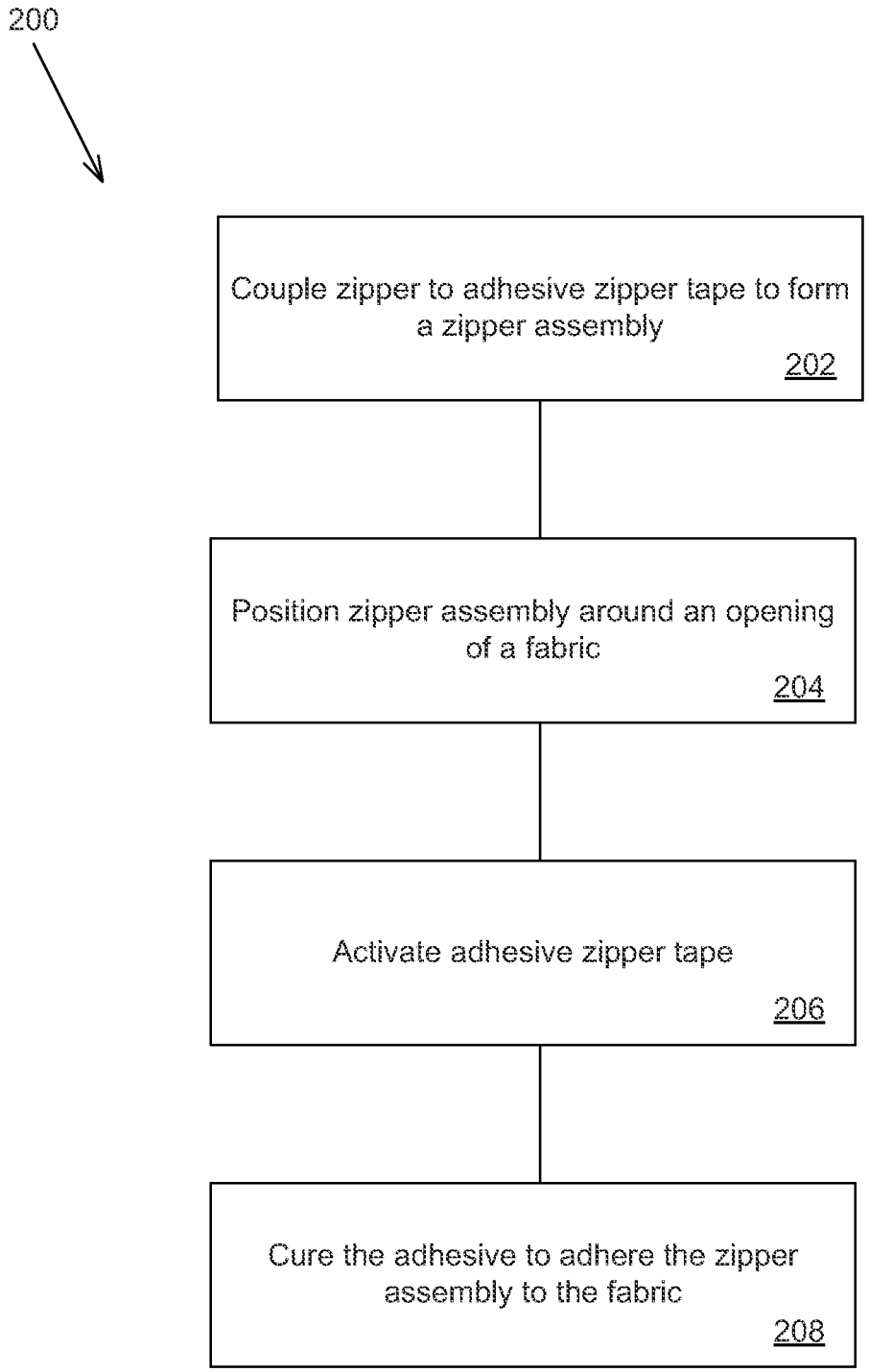
FIG. 2 illustrates a method of manufacturing a zipper assembly including adhesive zipper tape and applying the adhesive zipper tape to fabric in accordance with various embodiments.

Various embodiments provide a method of manufacturing a zipper assembly with adhesive zipper tape and a method of coupling the adhesive zipper tape to an opening that is to be opened and closed by the zipper. FIG. 2 illustrates a method 200 of manufacturing an adhesive zipper take and applying the zipper tape to a fabric in accordance with various embodiments.

At block 202, a zipper (e.g., including a pair of zipper teeth sets) is coupled to an adhesive zipper tape to form a zipper assembly. As discussed above, the adhesive zipper tape may be a single adhesive component or manufactured from several components. In some embodiments, the adhesive zipper tape may be an elongate piece of material (e.g., in the form of a roll and/or sheet). The zipper tape may be cut to an appropriate length for the application before or after the zipper teeth are coupled to the zipper tape. For example, in some embodiments, the zipper teeth may be applied to a long piece of zipper tape, and then a portion of the zipper tape with zipper teeth attached thereto may be cut to a length appropriate for the application. In other embodiments, the zipper tape may be cut to the desired length prior to attaching the zipper teeth to the zipper tape. In some such embodiments, the zipper tape may have a length that is longer than a length of the sets of zipper teeth.

In some embodiments, the opposing sets of zipper teeth may be applied to different strips of adhesive zipper tape. In other embodiments, an opening may be cut in the zipper tape and the zipper teeth may then be coupled to the zipper tape.

The sets of zipper teeth may be coupled to the adhesive zipper tape by any suitable method, such as by an adhesive, by stitching, molding, crimping, and/or direct injection. In embodiments where the sets of zipper teeth are attached to the adhesive zipper tape by a method involving high heat, a cover paper (release liner) or other protection mechanism may be applied to the zipper tape to avoid activating the adhesive of the zipper tape.

At 204, the zipper assembly is positioned around an opening in a fabric (e.g., in a single piece of fabric and/or an opening between two pieces of fabric). In other embodiments, the zipper assembly may be positioned on the fabric in a location where a zippered opening is desired, and the opening may be cut after the zipper tape is adhered to the fabric.

At 206, the adhesive of the zipper tape is activated. The adhesive may be activated by any suitable method. For example, in embodiments where the adhesive is heat-activated, the zipper tape may be applied by heat press, ultrasonic, radio frequency, and/or other welding method. In some embodiments, pressure may also be applied to the adhesive zipper tape (e.g., by a heat press and/or other means) to apply the zipper tape to the fabric.

At 208, the adhesive is cured to adhere the adhesive zipper tape to the fabric. In embodiments where the adhesive is heat-activated, the adhesive may be cured by removing the combined zipper assembly and the fabric from the heat and allowing the zipper tape to cool. The zipper tape may be cooled by active and/or inactive means. The adhesive may cure, thereby permanently or semi-permanently attaching the zipper to the fabric opening. Once the combined adhesive zipper tape has cooled and the adhesive has properly cured, other manufacturing processes, e.g., cutting, sewing, packing etc. may be performed.

Figure 3A:
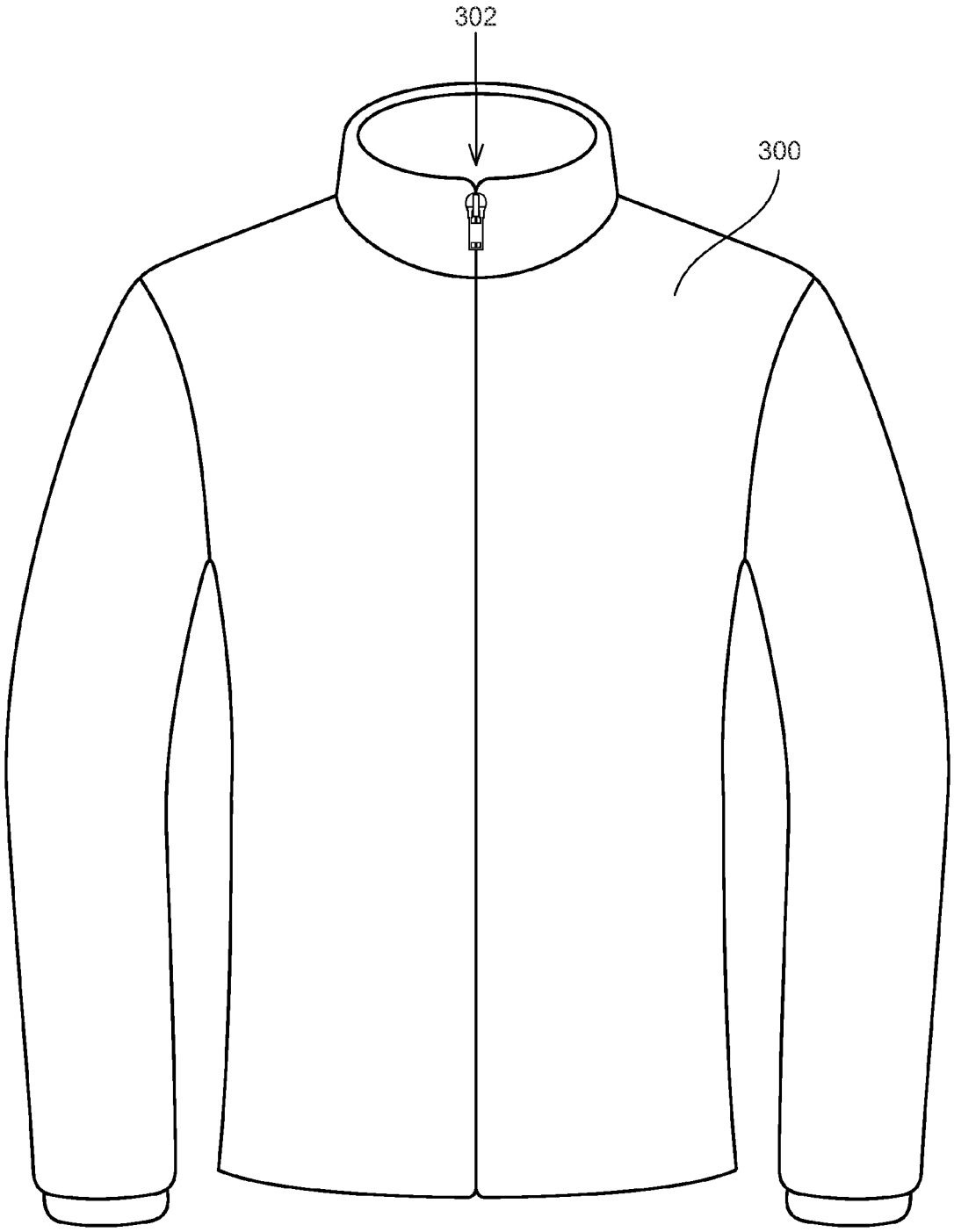
FIG. 3A illustrates a front view of a jacket showing a zipper assembly coupled to the jacket in accordance with various embodiments.
Figure 3B:
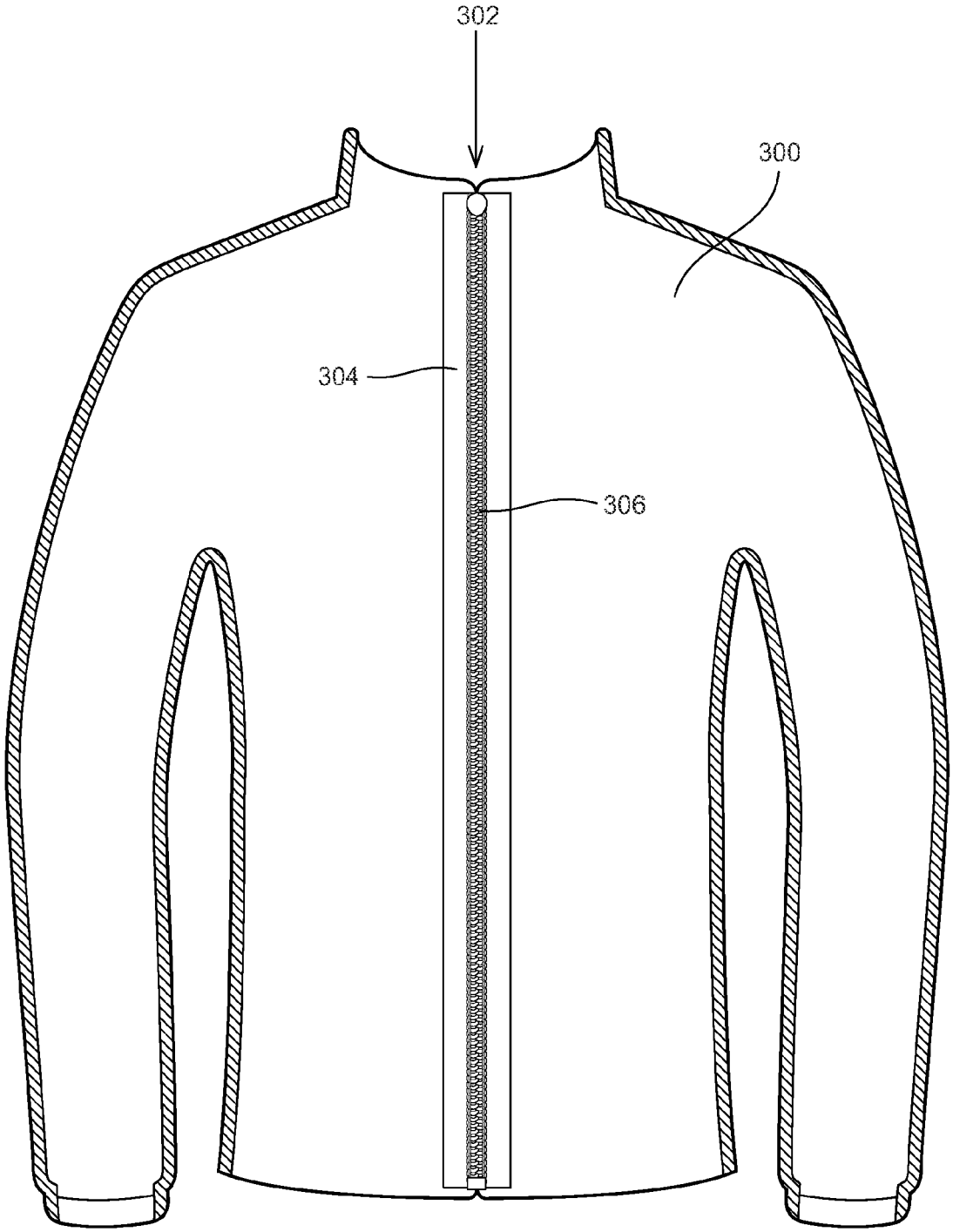
FIG. 3B illustrates an interior, cross-sectional view of the jacket of FIG. 3A showing the zipper assembly coupled to the jacket in accordance with various embodiments.

FIG. 3A illustrates a front view of a jacket 300 showing an adhesive zipper assembly 302 coupled to jacket 300. FIG. 3B illustrates an interior, cross-sectional view of jacket 300 showing the adhesive zipper assembly coupled to the jacket in accordance with various embodiments. Adhesive zipper assembly 302 comprises zipper tape 304 and zipper 306. Zipper 306 is coupled to zipper tape 304 via stitching 308. As shown, adhesive zipper assembly is not stitched to jacket 300, but rather is coupled to jacket 300 using an adhesive. This illustrates a benefit of this arrangement, namely that adhesive zipper tape can be secured to a garment without additional stitching, thus saving time and expense, and eliminating a location of water ingress. Alternatively, stitching may be used as an additional securing mechanism in combination with adhesive.

FIGS. 3A and 3B show an opening in jacket 300 and zipper 306 that is mostly obscured by the overlying fabric of jacket 300. The size of the opening may vary such that some of the zipper tape is visible from the front of jacket 300 or, alternatively the fabric may meet/touch such that the zipper assembly is obscured from view. In an embodiment, configuring a jacket front without exposed zipper tape permits a reduction in the thickness/strength/integrity of the zipper tape as the strength and integrity of the jacket in that region are provided by the exterior jacket fabric. When exposed, zipper tape essentially acts as part of the garment fabric and greater strength would be desired to prevent failure, tearing, etc. of the zipper tape.

The methods described above may be carried out in any order and are not limited to the order in which they are described. For example, as stated above, in some embodiments the sets of zipper teeth may be coupled to the adhesive zipper tape prior to cutting the adhesive zipper tape to the appropriate size. In some such embodiments, a long strip and/or roll of zipper with adhesive zipper tape may be created and then cut to appropriate lengths as needed.

In various embodiments, the zipper slider may be coupled to the zipper teeth before or after the zipper tape is coupled with the fabric.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A zipper assembly comprising:

an adhesive zipper tape that consists of a single component non-woven polymeric film, wherein the single component is a heat-activated adhesive, wherein the adhesive zipper tape includes a first edge and a second edge opposite the first edge, and wherein the adhesive zipper tape has a width between the first edge and the second edge; and a zipper including zipper teeth that are connected directly to the adhesive zipper tape at or near the first edge by stitching, molding, crimping, or direct injection, wherein the adhesive zipper tape manifests an adhesive quality only as a result of being subjected to heat, and wherein the zipper tape extends away from the zipper teeth toward the second edge.

2. The zipper assembly of claim 1 further comprising a zipper slider coupled to at least one of the first set of zipper teeth and the second set of zipper teeth, and configured to interlock the first set of zipper teeth with the second set of zipper teeth as the zipper slider moves in a first direction along a zipper axis.

3. The zipper assembly of claim 1, wherein the single component is polyurethane, polyamide, polyester, polyolefin, or polyethylene.

4. A zipper assembly comprising:

an adhesive zipper tape that consists of an adhesive mixed or dispersed with a stabilizing material to form a single layer non-woven polymeric film, wherein the adhesive zipper tape includes a first edge and a second edge opposite the first edge, and wherein the adhesive zipper tape has a width between the first edge and the second edge; and a zipper including zipper teeth that are connected directly to the adhesive zipper tape at or near the first edge, wherein the adhesive zipper tape extends away from the zipper teeth toward the second edge.

5. The zipper assembly of claim 4, wherein the adhesive includes polyurethane, polyamide, polyester, polyolefin, or polyethylene.

6. The zipper assembly of claim 4, wherein the stabilizing material includes polyurethane, nylon, polyester, polyethylene or acrylic.

7. The zipper assembly of claim 4, wherein the first and second sets of zipper teeth are connected to the zipper tape by stitching, molding, crimping, or direct injection.

8. A method comprising attaching first and second sets of zipper teeth directly to respective strips of an adhesive zipper tape at or near a first edge of the strip by stitching, molding, crimping, or direct injection to form a zipper assembly, the adhesive zipper tape consisting of a single component non-woven polymeric film, wherein the single component is a heat-activated adhesive, and wherein the strips include a second edge opposite the first edge and have a width between the first edge and the second edge;

applying the zipper assembly to a fabric; and subjecting the adhesive zipper tape to heat to activate an adhesive quality of the adhesive zipper tape.

9. The method of claim 8, wherein subjecting the adhesive zipper tape to heat comprises heating the adhesive zipper tape to an activation temperature or above.

10. The method of claim 9, further comprising cooling the adhesive zipper tape to secure the adhesive zipper tape to the fabric.

11. The method of claim 9, wherein the heating comprises applying a heat press to the adhesive zipper tape.

12. A garment comprising:

a fabric;

a zipper assembly coupled to the fabric, the zipper assembly including:

an adhesive zipper tape consisting of an adhesive and a stabilizing material mixed or dispersed to form a single layer non-woven polymeric film, wherein the adhesive zipper tape includes a first edge and a second edge opposite the first edge, and wherein the adhesive zipper tape has a width between the first edge and the second edge; and a zipper including zipper teeth that are connected directly to the adhesive zipper tape at or near the first edge, wherein the adhesive zipper tape extends away from the zipper teeth toward the second edge.

13. The garment of claim 12, wherein the adhesive zipper tape manifests an adhesive quality only as a result of being subjected to an activation stimulus.

14. The garment of claim 13, wherein the adhesive quality of the zipper tape is heat-activated.

* * * * *